US011186089B2

(12) United States Patent
White et al.

(10) Patent No.: US 11,186,089 B2
(45) **Date of Patent: *Nov. 30, 2021**

(54) INK JET PRINITHEAD

(71) Applicant: HEWLETT-PACKARD DEVELOPMENT COMPANY, L.P., Spring, TX (US)

(72) Inventors: Lawrence H. White, Corvallis, OR (US); Thomas J. Cardinali, Corvallis, OR (US); Michael Hager, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,223

(22) Filed: Sep. 19, 2019

(65) Prior Publication Data

US 2020/0009867 A1 Jan. 9, 2020

Related U.S. Application Data

(63) Continuation of application No. 15/521,285, filed as application No. PCT/US2014/063183 on Oct. 30, 2014, now Pat. No. 10,457,048.

(51) Int. Cl.

| | |
|---|---|
| ***B41J 2/14*** | (2006.01) |
| ***B41J 2/16*** | (2006.01) |
| ***B41J 2/175*** | (2006.01) |

(52) U.S. Cl.

CPC ..... *B41J 2/1604* (2013.01); *B41J 2/14129* (2013.01); *B41J 2/1603* (2013.01); *B41J 2/164* (2013.01); *B41J 2/1626* (2013.01); *B41J 2/1631* (2013.01); *B41J 2/175* (2013.01)

(58) Field of Classification Search

CPC ..... B41J 2/14129

See application file for complete search history.

(56) References Cited

U.S. PATENT DOCUMENTS

| | | | |
|---|---|---|---|
| 4,746,935 | A | 5/1988 | Allen |
| 5,107,276 | A | 4/1992 | Kneezel et al. |
| 5,526,027 | A | 6/1996 | Wade et al. |
| 6,022,098 | A | 2/2000 | Fujii |

(Continued)

FOREIGN PATENT DOCUMENTS

| | | | |
|---|---|---|---|
| CN | 1182677 | A | 5/1998 |
| CN | 1254647 | A | 5/2000 |

(Continued)

OTHER PUBLICATIONS

Ezzeldin, et al. Publication date:Sep. 8-10, 2010 Title:Model-free Optimization Based Feedforward Control for an Inkjet Printhead http://ieeexpiore.ieee.org/xpl/articleDelails.j.

*Primary Examiner* — Sharon Polk

(74) *Attorney, Agent, or Firm* — Middleton Reutlinger

(57) ABSTRACT

Printheads and methods for forming printheads are described herein. In one example, a printhead includes a single resistor window in a conducting layer within the printhead. The printhead also includes a number of resistors formed in a resistor film deposited over the single resistor window. The resistors have two different widths, and each of the two different widths ejects a different droplet size when energized.

20 Claims, 11 Drawing Sheets

500

(56) References Cited

U.S. PATENT DOCUMENTS

| | | | | |
|---|---|---|---|---|
| 6,113,221 | A | 9/2000 | Weber | |
| 6,284,436 | B1 | 9/2001 | Ahn et al. | |
| 6,467,864 | B1 | 10/2002 | Cornell | |
| 7,517,040 | B2 | 4/2009 | Takata | |
| 8,070,262 | B2 | 12/2011 | Yamaguchi et al. | |
| 8,141,986 | B2 | 3/2012 | Chung et al. | |
| 8,210,660 | B2 | 7/2012 | Anderson et al. | |
| 8,439,477 | B2 | 5/2013 | Markham et al. | |
| 10,457,048 | B2 * | 10/2019 | White | B41J 2/175 |
| 2002/0075346 | A1 | 6/2002 | Genbao et al. | |
| 2002/0135640 | A1 | 9/2002 | Chen et al. | |
| 2003/0103105 | A1 | 6/2003 | Naoto | |
| 2011/0310182 | A1 | 12/2011 | Mardilovich et al. | |
| 2013/0033551 | A1 | 2/2013 | Haggai | |
| 2013/0162724 | A1 | 6/2013 | Pugliese et al. | |
| 2014/0224786 | A1 | 8/2014 | Cook et al. | |
| 2015/0290935 | A1 * | 10/2015 | Tamatsukuri | B41J 2/14112 347/61 |

FOREIGN PATENT DOCUMENTS

| | | | |
|---|---|---|---|
| CN | 102333656 | A | 1/2012 |
| CN | 103328221 | A | 9/2013 |
| EP | 0867285 | A2 | 9/1998 |
| EP | 1078754 | A2 | 2/2001 |
| JP | H07-153603 | | 6/1995 |
| JP | 2003-145769 | | 5/2003 |
| JP | 2003-311964 | | 11/2003 |
| JP | 2005-153435 | | 6/2005 |
| JP | 2007-269011 | | 10/2007 |
| JP | 2009-040035 | | 2/2009 |
| JP | 2009-143228 | | 7/2009 |
| JP | 2011-525437 | | 9/2011 |
| WO | WO-8703363 | | 6/1987 |
| WO | WO2006072899 | | 7/2006 |
| WO | WO-2010098743 | | 9/2010 |
| WO | WO-2014/007814 | | 1/2014 |

* cited by examiner

100

200

400

400

400

500

600

600

800

800

800

1000

INK JET PRINITHEAD

CROSS REFERENCE TO RELATED APPLICATIONS

The present application is a continuation of U.S. patent application Ser. No. 15/521,285, filed on Apr. 22, 2017, which is a U.S. National Stage under 35 U.S.C. § 371 of International Patent Application No. PCT/US2014/063183, filed Oct. 30, 2014, the disclosures of which are hereby incorporated herein by reference.

BACKGROUND

Thermal ink jet printheads are fabricated with multiple columns of heater resistors. The printheads are formed using fabrication techniques similar to those used for integrated circuits, e.g., deposition of layers on a wafer, following by masking, photo cross-linking, and etching. The conventional design for the mask used to create openings for the heater resistors uses a single rectangle about each resistor. One advantage of this design is that the resistor lengths do not need to be identical in cases where there was a reason to have different resistor lengths. However, the topography is more complex for this arrangement, creating reflections that make higher layers uneven.

BRIEF DESCRIPTION OF THE DRAWINGS

Certain examples are described in the following detailed description and in reference to the drawings, in which.

DETAILED DESCRIPTION OF SPECIFIC EXAMPLES

The techniques disclosed herein describe techniques for forming printheads for ink jet printers. These printheads can be designed to have interstitial dual drop weight by alternating the design of the drop generator, including the heater resistors, down the columns of the printheads. The resistor area increases with the drop weight, and the firing energy increases with the resistor area. The energy is supplied as one or more electrical pulses (firing pulses) of known voltage and pulse width. In some cases a simple trapezoidal firing pulse is used, while in others a series of two smaller firing pulses with a brief dead time between them is used.

Correct operation of the printhead requires the energy to be within a narrow range. With insufficient energy, poor or no drop ejection will occur. In contrast, with excessive energy, the printhead will not adequately drive ink droplets to the print medium, as larger gas bubbles will be created by outgassing from the fluid. The operating temperature is correlated to overenergy, and can affect the ratio between the actual energy applied and the minimum energy necessary to eject drops. When two different resistors are used on the same printhead, for example, for different droplet sizes, care must be taken to assure the correct pulse is used for each resistor. Thus, separate resistor windows for each resistor, for example, of different lengths, may lead to distinct firing pulses for low and high drop weight. The use of different firing pulse creates complicated control strategies.

Further, the use of multiple resistor windows creates a complex topology below the top layers that can cause imperfections in the imaging of the flow channels, through which the ink is fed to the printhead. For example, the fluid flow channels on the printhead can be constructed from a photoimageable epoxy. This material will cross-link where exposed to light and, thus, it can be exposed with a mask and developed to form structures. The flow channels are located above the resistor films and are imaged after the resistor films have been processed and overcoated with various other layers, such as a dielectric layer and a reflective layer of tantalum. The reflections from the uneven topography in the resistor layer have been found to affect the quality of the epoxy imaging.

In examples described herein a single resistor window is formed by the partial removal of an aluminum layer from the top of a wafer. A layer of a resistor material is then deposited over the entire wafer, and traces are etched from the layers of resistor material and aluminum. The resistors are formed in the areas from which the aluminum was removed, leaving only the resistor material to conduct current through the trace.

Figure 1:
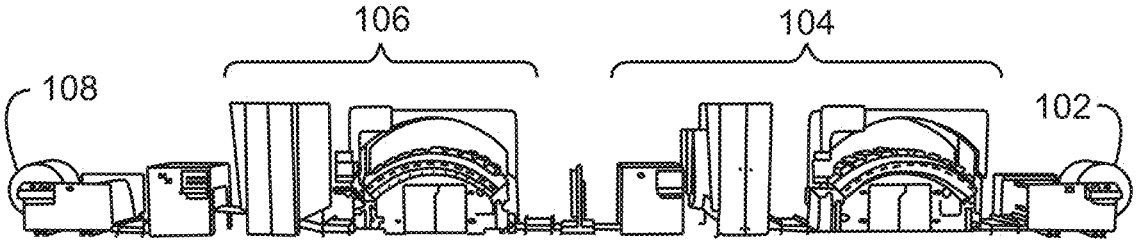
FIG. 1 is a drawing of an example printing press that uses ink jet printheads to form images on a print medium.

FIG. 1 is a drawing of an example of a printing press 100 that uses ink jet printheads to form images on a print medium. The printing press 100 can feed a continuous sheet of a print medium from a large roll 102. The print medium can be fed through a number of printing systems, such as printing system 104. In the printing system 104 a printbar that houses a number of printheads ejects ink droplets onto the print medium. A second printing system 106 may be used to print additional colors. For example, the first system 104 may print black, while the second system 106 may print cyan, magenta, and yellow (CMY). The printing systems 104 and 106 are not limited to two, or the mentioned color combinations, as any number of systems may be used, depending, for example, on the colors desired and the speed of the printing press 100.

After the second system 106, the printed print medium may be taken up on a take-up roll 108 for later processing. In some examples, other units may replace the take-up roll 108, such as a sheet cutter and binder, among others.

Figure 2:
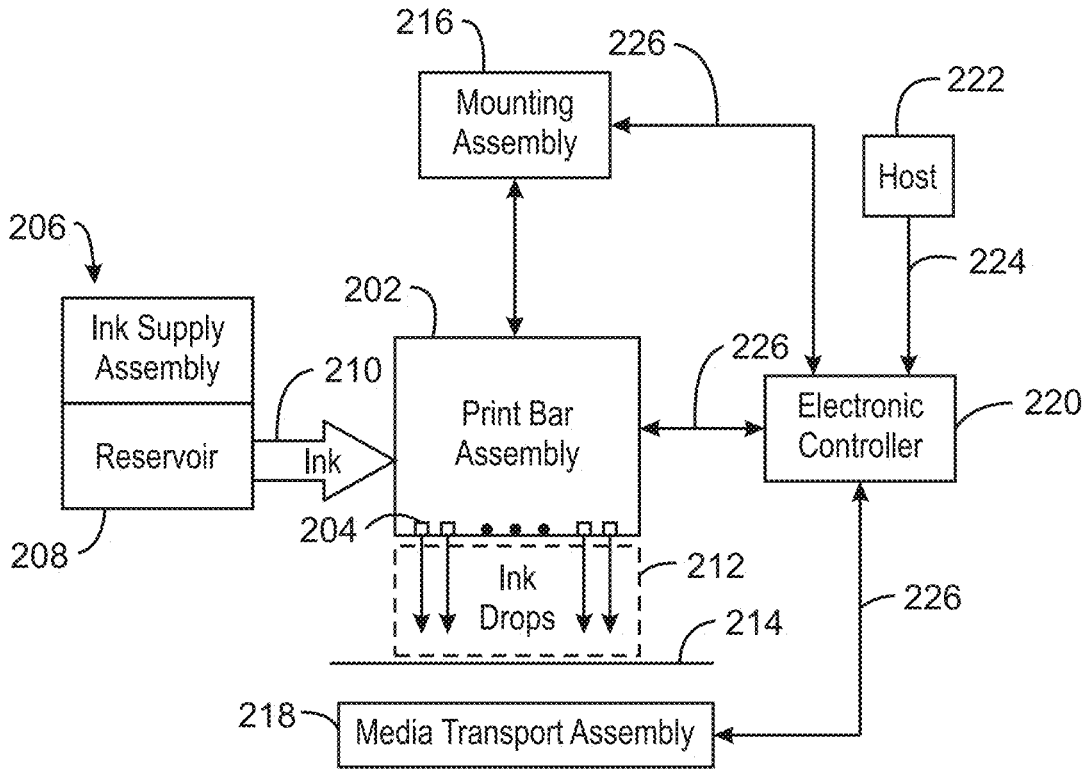
FIG. 2 is a block diagram of an example of an ink jet printing system that may be used to form images using ink jet printheads.

FIG. 2 is a block diagram of an example of an ink jet printing system 200 that may be used to form images using ink jet printheads. The ink jet printing system 200 includes a printbar 202, which includes a number of printheads 204, and an ink supply assembly 206. The ink supply assembly 206 includes an ink reservoir 208. From the ink reservoir 208, ink 210 is provided to the printbar 202 to be fed to the printheads 204. The ink supply assembly 206 and printbar 202 may use a one-way ink delivery system or a recirculating ink delivery system. In a one-way ink delivery system, substantially all of the ink supplied to the printbar 202 is consumed during printing. In a recirculating ink delivery system, a portion of the ink 210 supplied to the printbar 202 is consumed during printing, and another portion of the ink is returned to ink supply assembly. In an example, the ink supply assembly 206 is separate from the printbar 202, and supplies the ink 210 to the printbar 202 through a tubular connection, such as a supply tube (not shown). In other examples, the printbar 202 may include the ink supply assembly 206, and ink reservoir 208, along with a printhead 202, for example, in single user printers. In either example, the ink reservoir 208 of the ink supply assembly 206 may be removed and replaced, or refilled.

From the printheads 204 the ink 210 is ejected from nozzles as ink droplets 212 towards a print medium 214, such as paper, Mylar, cardstock, and the like. The nozzles of the printheads 204 are arranged in one or more columns or arrays such that properly sequenced ejection of ink 210 can form characters, symbols, graphics, or other images to be printed on the print medium 214 as the printbar 202 and print medium 214 are moved relative to each other. The ink 210 is not limited to colored liquids used to form visible images on a print medium, for example, the ink 210 may be an electro-active substance used to print circuit patterns, such as solar cells.

A mounting assembly 216 may be used to position the printbar 202 relative to the print medium 214. In an example, the mounting assembly 216 may be in a fixed position, holding a number of printheads 204 above the print medium 214. In another example, the mounting assembly 216 may include a motor that moves the printbar 202 back and forth across the print medium 214, for example, if the printbar 202 only included one to four printheads 204. A media transport assembly 218 moves the print medium 214 relative to the printbar, for example, moving the print medium 214 perpendicular to the printbar 202. In the example of FIG. 1, the media transport assembly 218 may include the rolls 102 and 108, as well as any number of motorized pinch rolls used to pull the print medium through the printing systems 104 and 106. If the printbar 202 is moved, the media transport assembly 218 may index the print medium 214 to new positions. In examples in which the printbar 202 is not moved, the motion of the print medium 214 may be continuous.

A controller 220 receives data from a host system 222, such as a computer. The data may be transmitted over a network connection 224, which may be an electrical connection, an optical fiber connection, or a wireless connection, among others. The data 220 may include a document or file to be printed, or may include more elemental items, such as a color plane of a document or a rasterized document. The controller 220 may temporarily store the data in a local memory for analysis. The analysis may include determining timing control for the ejection of ink drops from the printheads 204, as well as the motion of the print medium 202 and any motion of the printbar 202. The controller 220 may operate the individual parts of the printing system over control lines 226. Accordingly, the controller 220 defines a pattern of ejected ink drops 212 which form characters, symbols, graphics, or other images on the print medium 214.

The ink jet printing system 200 is not limited to the items shown in FIG. 2. For example, the controller 220 may be a cluster computing system coupled in a network that has separate computing controls for individual parts of the system. For example, a separate controller may be associated with each of the mounting assembly 216, the printbar 202, the ink supply assembly 206, and the media transport assembly 218. In this example, the control lines 226 may be network connections coupling the separate controllers into a single network. In other example, the mounting assembly 216 may not be a separate item from the printbar 202, for example, if no motion is needed by the printbar 202.

Figure 3:
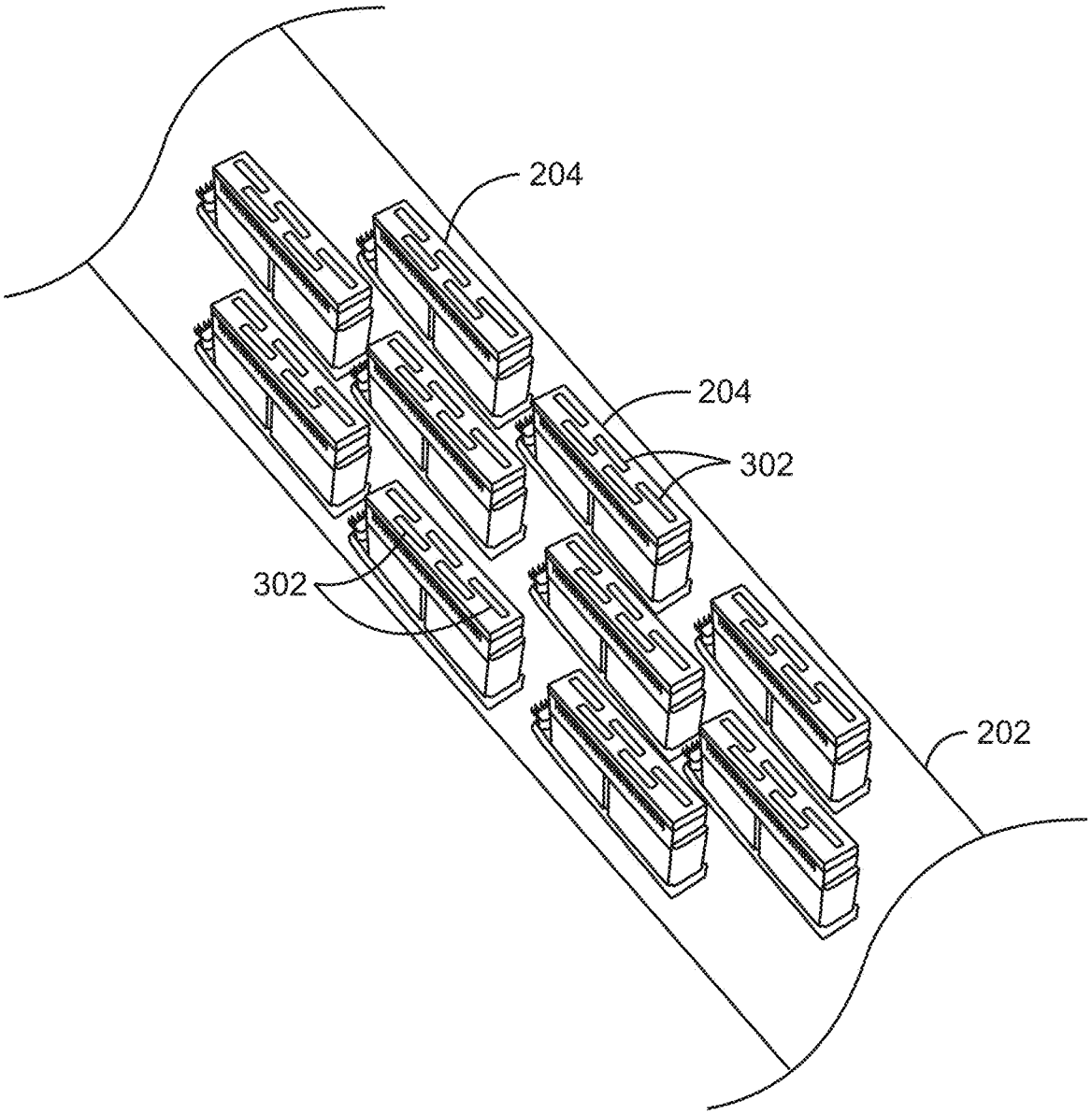
FIG. 3 is a drawing of a cluster of ink jet printheads in an example print configuration, for example, in a printbar.

FIG. 3 is a drawing of a cluster of ink jet printheads 204 in an example print configuration, for example, in a printbar 202. Like numbered items are as described with respect to FIG. 2. The printbar 202 shown in FIG. 3 may be used in configurations that do not move the printhead. Accordingly, the printheads 204 may be attached to the printbar 202 in an overlapping configuration to give complete coverage. Each printhead 204 has multiple nozzle regions 302 that have the nozzles and circuitry used to eject ink droplets.

Figure 4A:
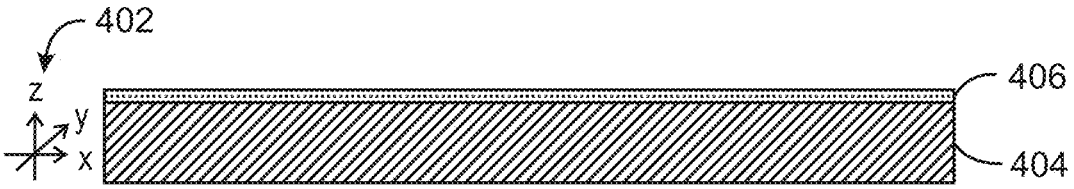
FIGS. 4A, 4B, and 4C are side cross sectional views of a wafer during the formation of a nozzle region of a printhead, showing the etching of a resistor window.
Figure 4B:
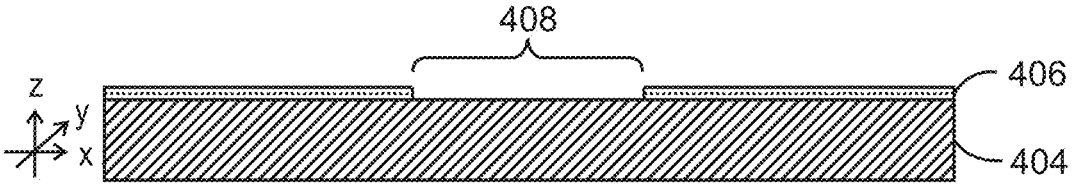
Figure 4C:
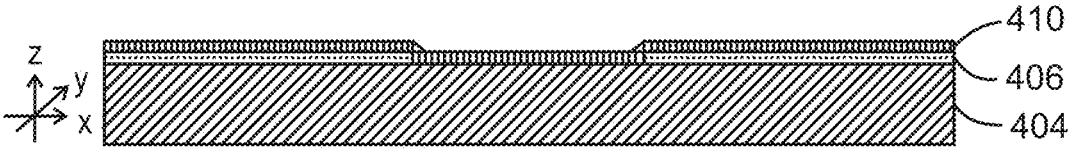

FIGS. 4A, 4B, and 4C are side cross sectional views of a wafer 400 during the formation of a nozzle region of a printhead, showing the etching of a resistor window. The axes 402 placed by the figure indicate the orientations of the wafer 400 relative to the following figures. Using techniques know in the art, the initial wafer 402 is fabricated to form the control electronics for powering the resistors. Vias, or conductive paths from the control circuitry, penetrate the dielectric at the top, providing connection points for the traces and resistors. As shown in FIG. 4A, the resistor processing is performed by first depositing a conductive layer 406, such as aluminum, on the initial wafer 404. The conductive layer 406 is then imaged and etched to leave behind the openings 408 where resistors are desired as shown in FIG. 4B. As described herein, a resistive layer 410, like tungsten-silicon-nitride (WSiN), is deposited over the whole structure, as shown in FIG. 4C. The resistive layer 410 and the conductive layer 406 below it are then imaged to form traces and resistors.

Figure 5:
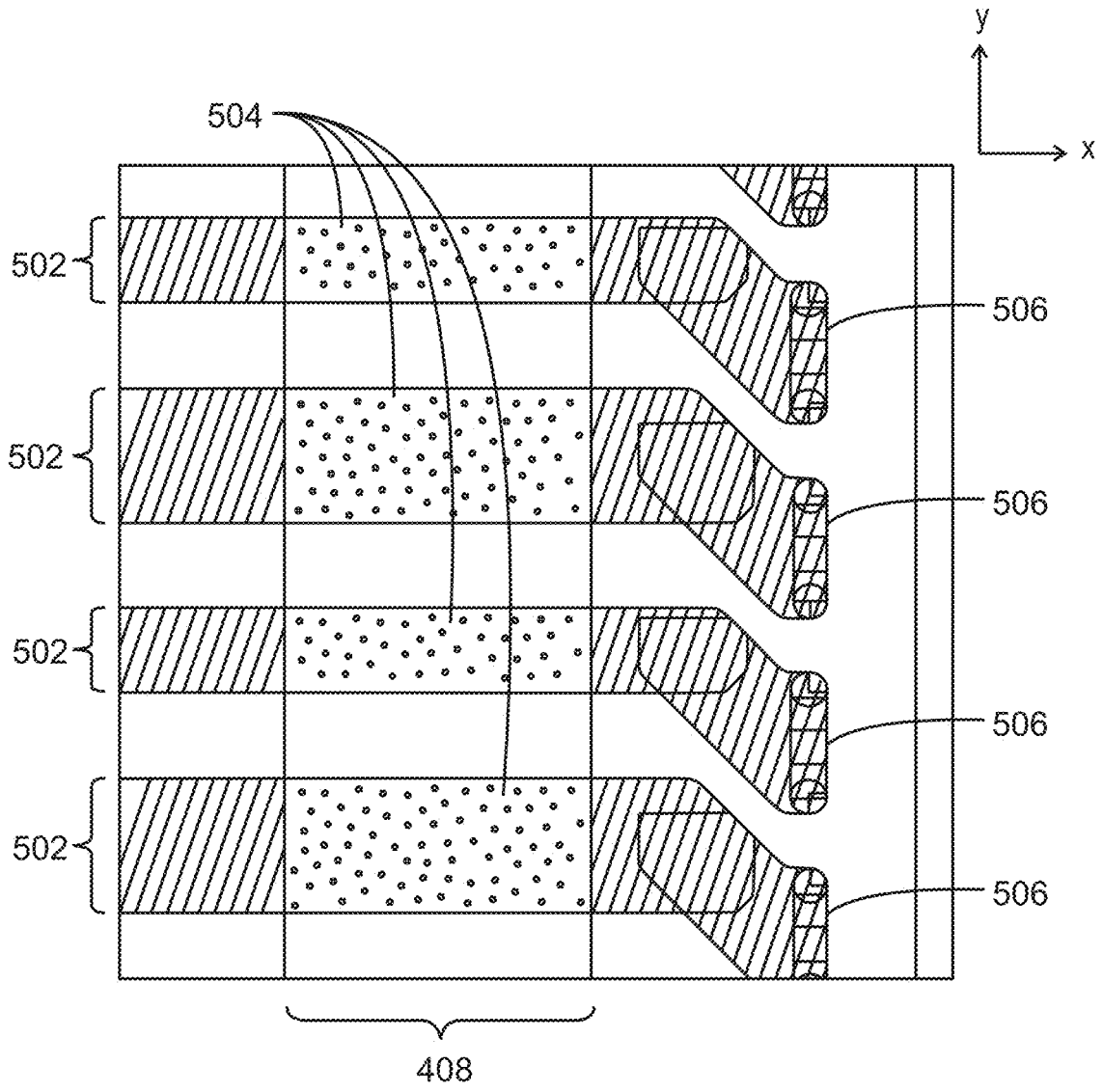
FIG. 5 is a top view of a wafer showing an example of a single resistor window etched across the wafer.

FIG. 5 is a top view of a wafer 500 showing an example of a single resistor window 408 etched across the wafer 500. Referring also to FIG. 4, traces 502 are formed at locations where the resistive film 410 was deposited over the conductive layer 406, while resistors 504 are formed wherever the resistive film 410 was deposited over openings 408 in the conductive layer 406. The process sequence creates topography on the sides of the resistors 504 from overetching that is performed at both steps. The traces 502 couple the resistors 504 to the driver circuitry located in lower layers through vias 506.

In the example shown in FIG. 5, a single resistor window 408 reduces topography. This reduces reflections, which may improve the imaging of subsequent layers, such as the epoxy material used for forming flow channels, as described with respect to FIGS. 9A and 9B.

Further, the single resistor window 408 can be used to create resistors 504 that all have the same length, although the width can be varied in order to meet the desired area for each resistor 504, which controls the drop weight. When resistors 504 have the same length, independent of the width or area, then each resistor 504 will operate at substantially the same overenergy when the same fire pulse is applied. Generally, the amount of energy applied to a resistor 504 to raise the temperature at the surface of the anticavitation film to about 320° C., e.g., the temperature at which a drive bubble forms, is the overenergy. The size of the droplet is directly proportional to the total amount of current used. A larger width resistor 504 will have a lower total resistance, and, thus, a larger current flow. In examples in which a constant resistor length is used for both of the widths of the resistors 504, the design and the printer firing strategy is simplified by the ability to use the same fire pulse for all resistors.

The techniques described herein are not limited to forming resistors 504 of equivalent lengths. In some examples, overlapping windows may still be formed for resistors of different lengths. This will reduce topography, even if different firing pulses are required for the different resistors.

Figure 6A:
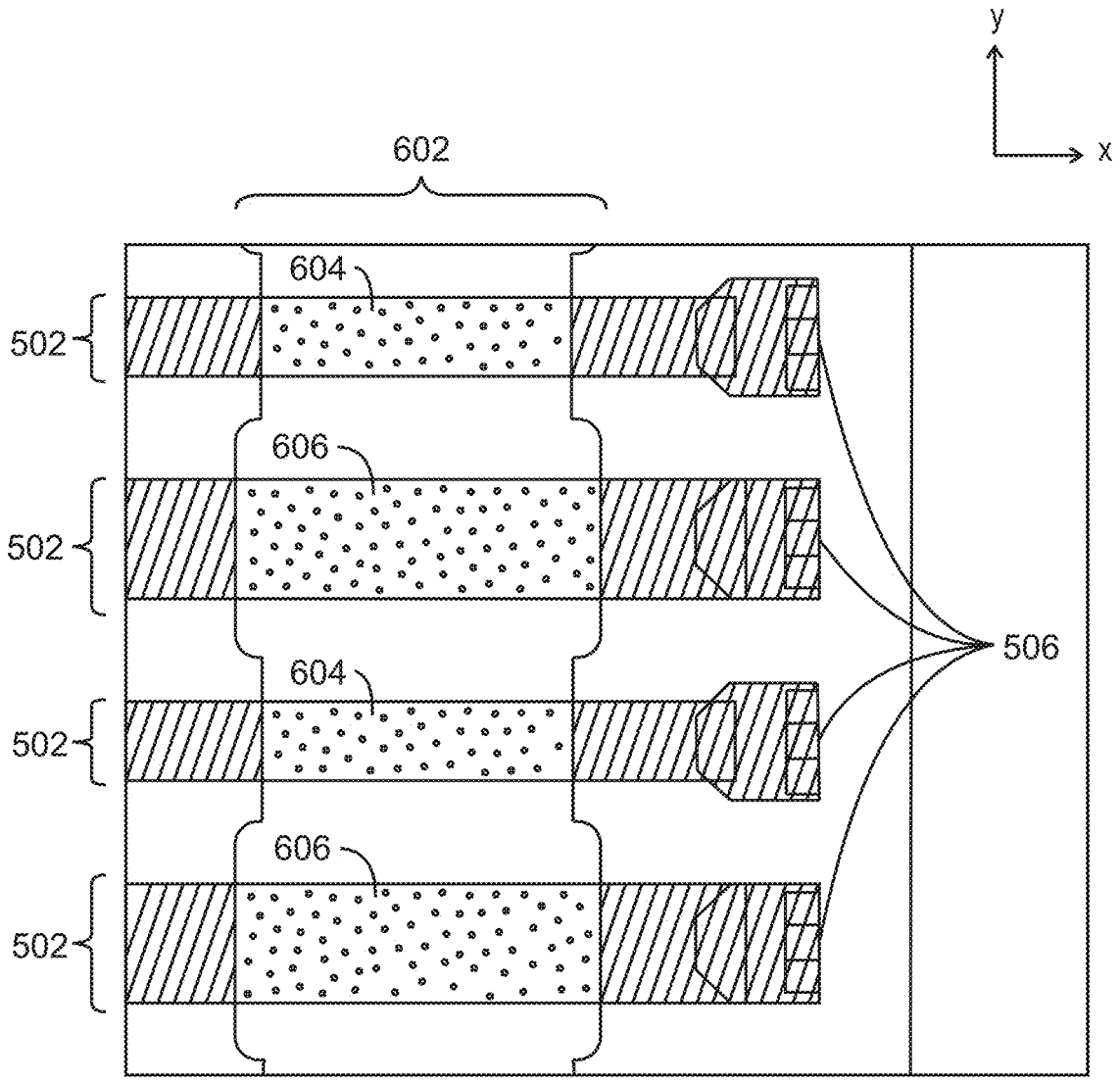
FIGS. 6A and 6B are a top view of a wafer showing an example of a single resistor window etched across a conductor layer, after which traces for a printhead were formed.
Figure 6B:
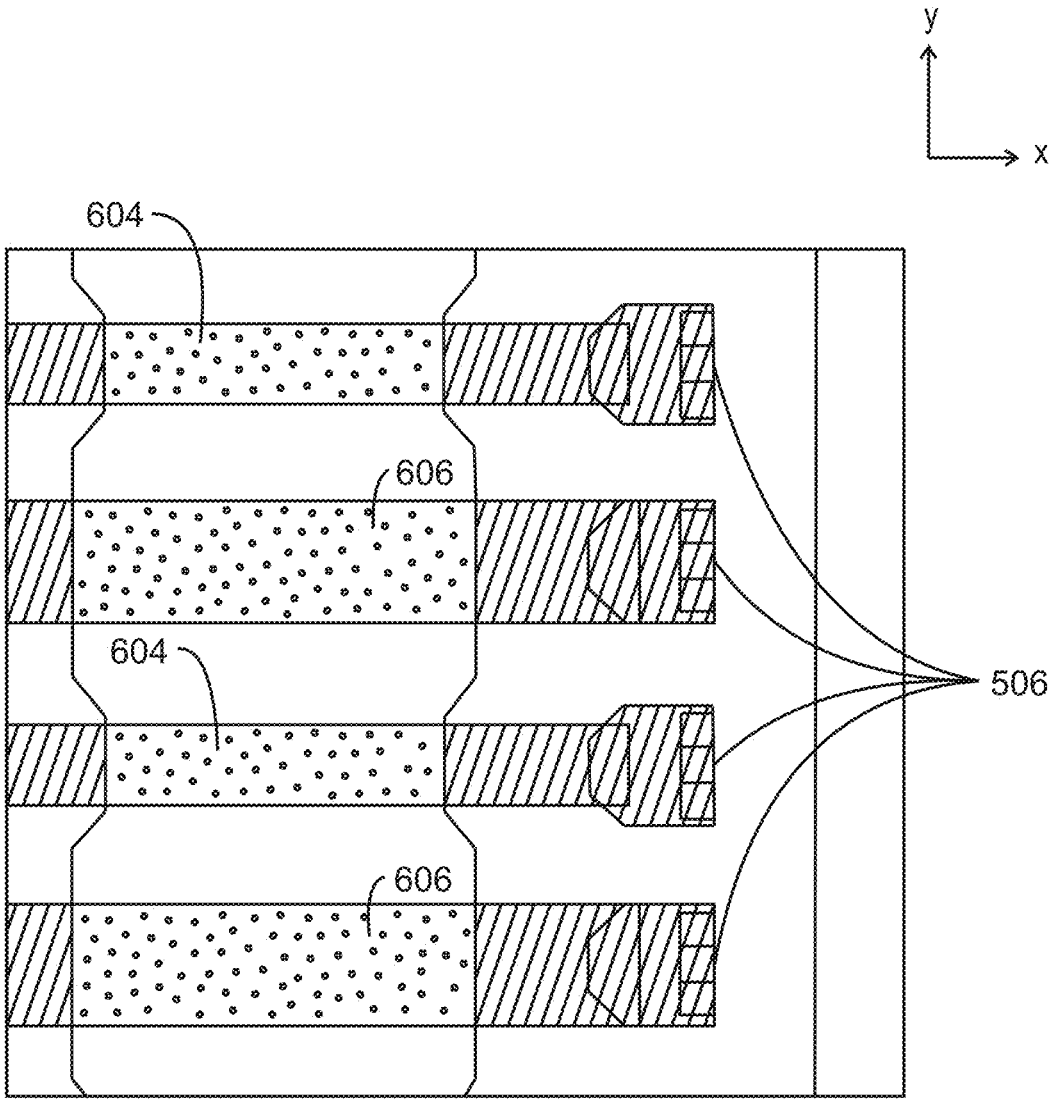

FIGS. 6A and 6B are a top view of a wafer 600 showing an example of a single resistor window 602 etched across a conductor layer, after which traces 502 for a printhead were formed. Like numbered items are as described with respect to FIG. 5. In this example, the width of the single resistor window 602 varies creating shorter resistors 604, for example, on narrow traces 502, and longer resistors 606, for example, on wider traces 502. The intersection between resistor openings for the two different resistors can be a simple overlap, e.g., creating a single window, as shown in the example in FIG. 6A or may be chamfered, as shown in the example in FIG. 6B. The single resistor window 602 will reduce the number of reflections, making the formation of the flow channels more even. However, the variation in the lengths of the resistors 604 and 606 will lead to different firing pulses for each, as the overenergy will differ. Accordingly, the control strategy for this arrangement will be more complex.

Figure 7A:
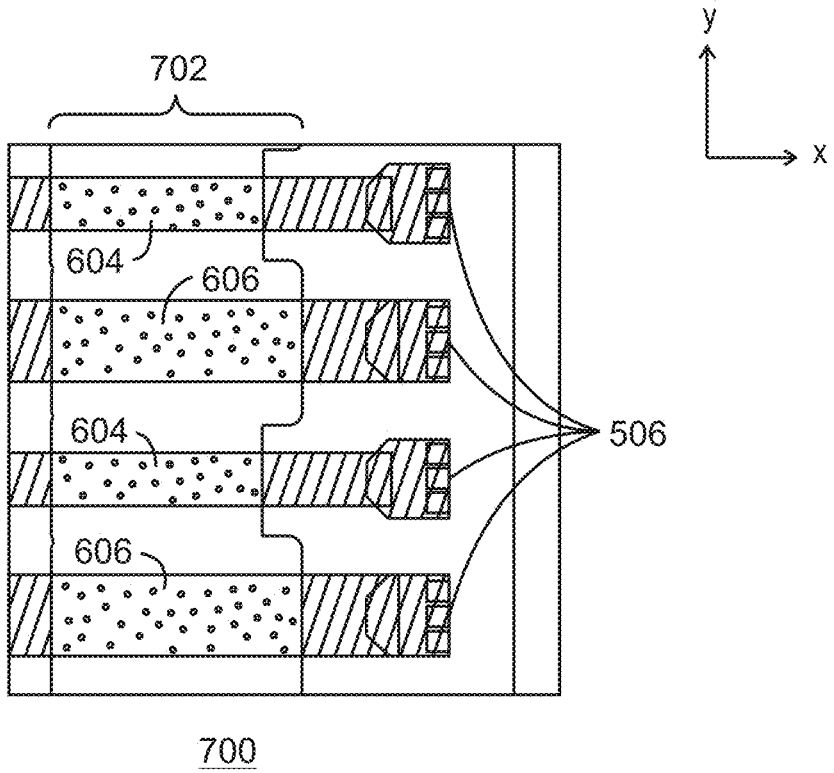
FIGS. 7A and 7B are a top view of a wafer showing an example of a single resistor window etched across a conductor layer, after which traces for a printhead were formed.
Figure 7B:
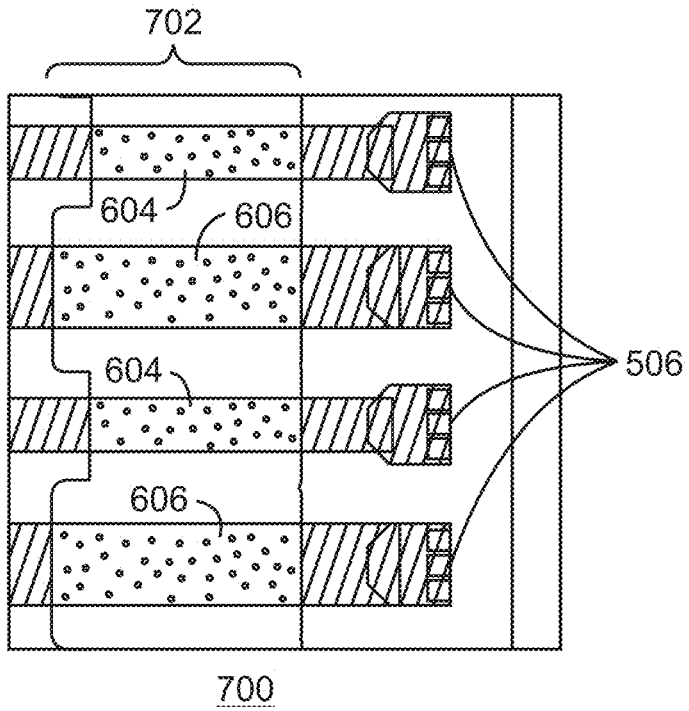

FIGS. 7A and 7B are a top view of a wafer 700 showing an example of a single resistor window 702 etched across a conductor layer, after which traces 502 for a printhead were formed. Like numbered items are as described with respect to FIGS. 5 and 6. In these examples, multiple resistor lengths are used, but the design justifies the resistors 602 and 604 at one end. This design will also limit reflections, improving processing over most of the resistor window 702. However, the imaging of the epoxy near the non-justified end will not improve, as the staggered windows will create extra reflections. In this example, the location of the justification may be chosen to improve different aspects of the design. For example, when the justification is located proximate to the ink feed, as shown in FIG. 7A, the refill time for the shifted resistor will be lower. In examples for which this is the lower of the two drop weights, lower refill is likely advantageous. When the justification is located farther from the ink feed, as shown in FIG. 7B, improved epoxy processing will result in higher quality, e.g., smoother, inflow channels.

Figure 8:
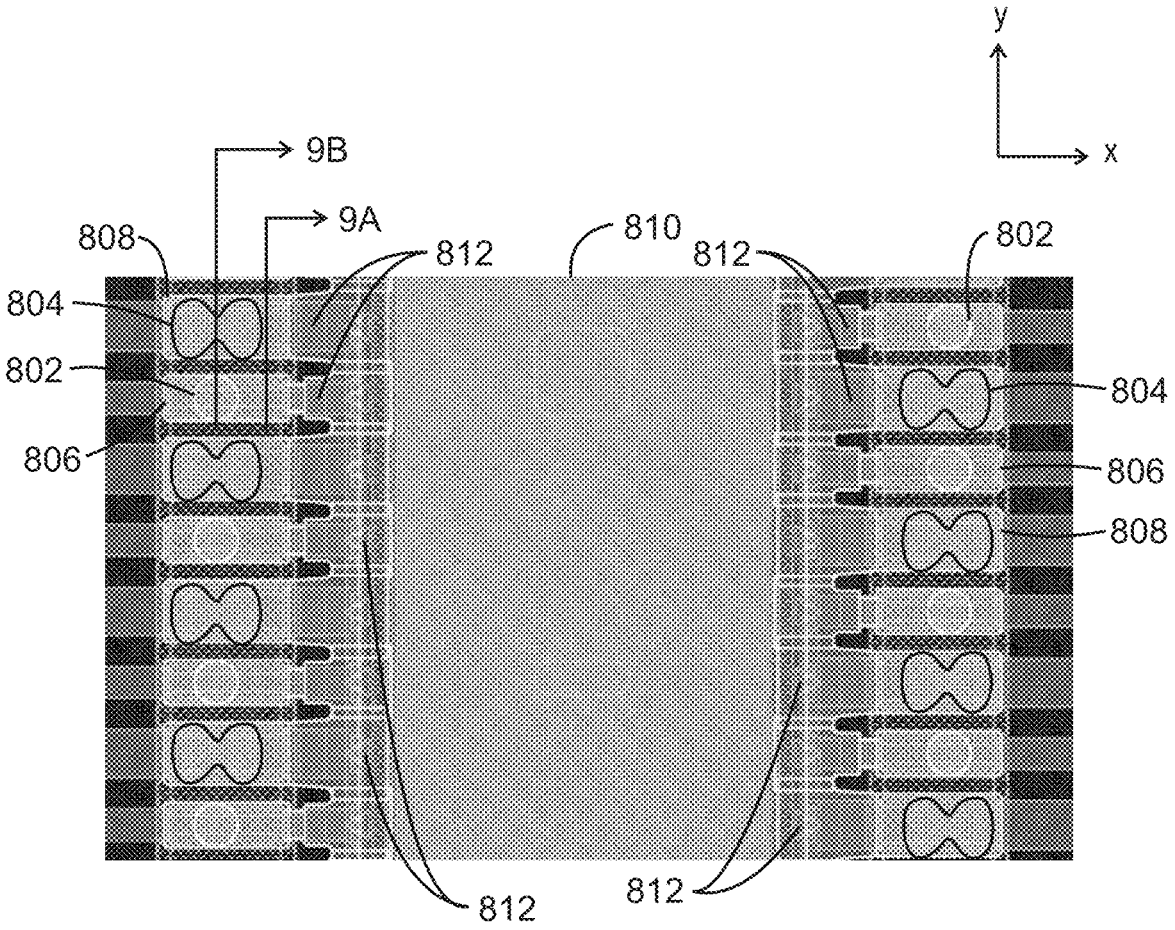
FIG. 8 is a top view of an example printhead showing adjacent nozzles over the resistors.

FIG. 8 is a top view of an example printhead 800 showing adjacent nozzles 802 and 804 over the resistors 806 and 808, respectively. A smaller nozzle 802 is located over a narrower resistor trace 806 to provide a smaller droplet size, for example, about 4 nanograms (ng) in weight. A larger nozzle 804 is located over a wider resistor trace 808 to provide a larger droplet size, for example, about 9 ng in weight. An ink refill region 810 is coupled to each nozzle 802 and 804 through a refill region 812 (to simplify the drawing, only a portion of the refill regions are labeled). Cross sectional views of the printhead 800, showing the additional layers formed, e.g., at line 9A through the refill regions 812 and at line 9B through the nozzles 802 and 804, are shown in FIGS. 9A and 9B, respectively.

Figure 9A:
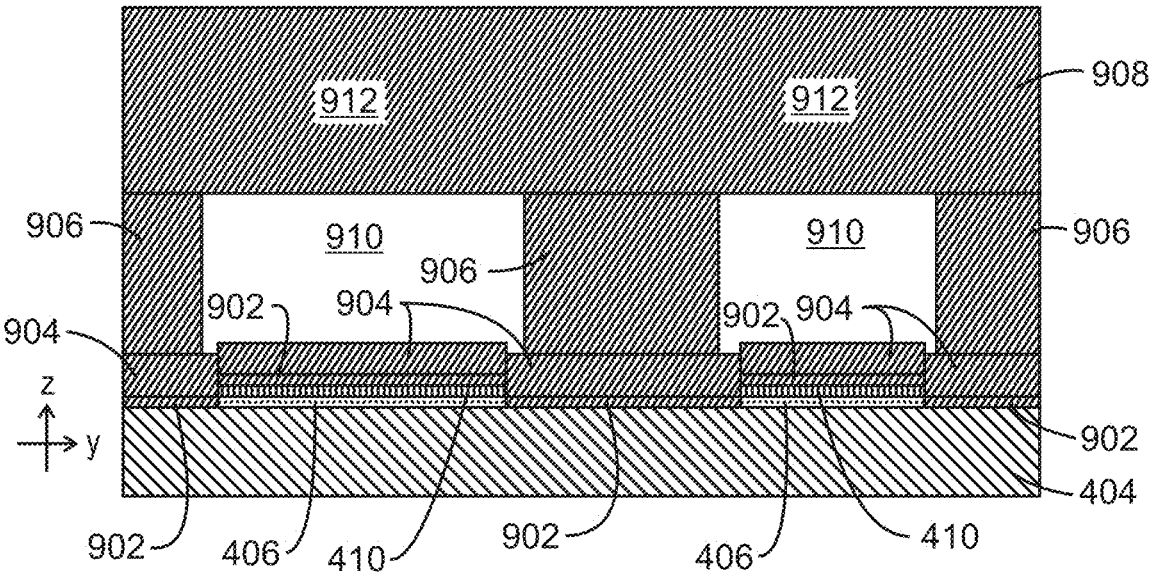
FIGS. 9A and 9B are cross sectional views of the printhead taken at the lines shown in FIG. 8, showing an example of the layers deposited over the resistors and traces to form the final printhead.
Figure 9B:
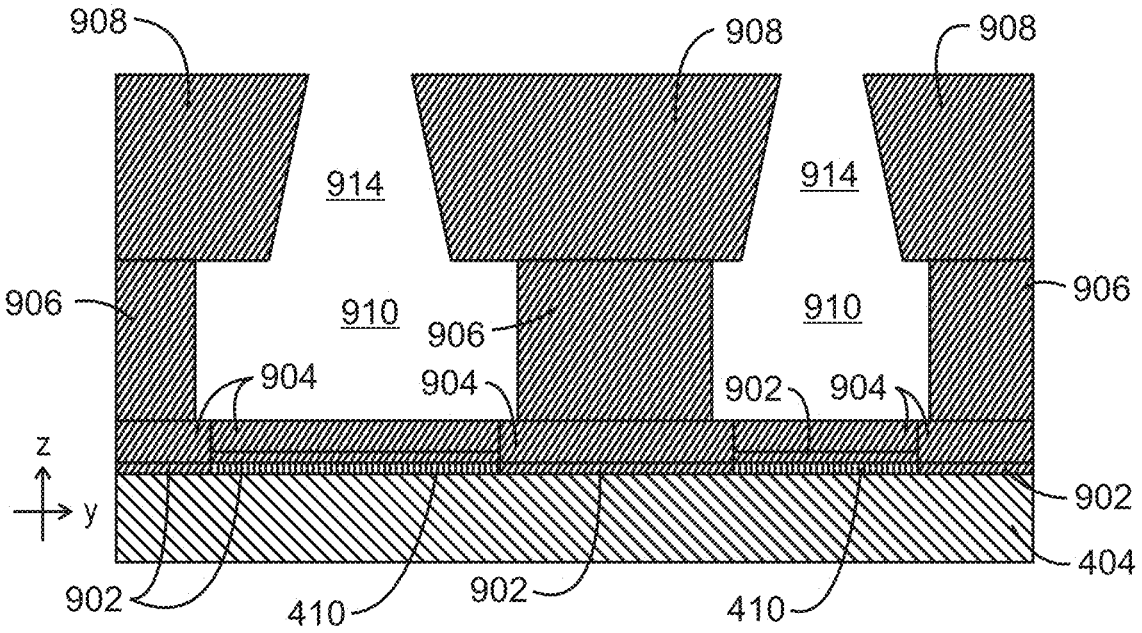

FIGS. 9A and 9B are cross sectional views of the printhead 800 taken at the lines shown in FIG. 8, showing an example of the layers deposited over the resistors and traces to form the final printhead 800. Like numbered items are as described with respect to FIGS. 4, 8, and 9. Once the conductor layer 406 and resistor layer 410 have been etched to form the traces and resistors, as described with respect to FIGS. 4-7, further layers can be formed to complete the printhead 800.

A passivation film may be deposited over the resistors and traces to insulate the resistors and traces from materials in subsequent layers, such as an anticavitation film. The passivation film may be formed from dual stacked layers of SiC over SiN. Other dielectric materials that may be used include $Al_2O_3$ and $HfO_2$, among others. The anticavitation film, such a tantalum layer, may be deposited over the passivation film. The anticavitation film decreases erosion from cavitation, e.g., the formation and collapse of bubbles at the top surface of the resistor. As the passivation and anticavitation layers are essentially thin films, they are not shown in FIG. 9. A dielectric layer 902 may then be deposited over the wafer to enhance the adhesion of photocurable polymers used to form the rest of the fluidic structure.

A primer layer 904 may be deposited to enhance the adhesion of the subsequent layers 906 and 908. The layers 904, 906, and 908 may be formed from the same, or different, photocurable polymers, such as epoxy resins (including two monomers) or epoxy copolymer resins (including three or more monomers) containing a ultraviolet (UV) photoinitiator to cause crosslinking. The photocurable polymer is coated in a layer over the surface, and then a mask is used to shield areas that can be removed. Exposure to UV light cross-links the resin in locations not protected by the mask. After light exposure, the areas that were shielded by the mask, and are not cross-linked, can be removed from the surface, for example, using a solvent. In some examples, this may be reversed, e.g., with a positive photoresist, in which areas that are exposed to the light break down, and can be removed by an etchant. In some examples, the primer layer 904 may be left over the entire structure, while in other cases the primer may be removed from the flow channel that leads into the ejection chamber.

After the primer layer 904 is cured, a second layer 906, such as another layer of photo-curable epoxy, can be deposited over the primer layer 904, and masked to allow the formation of walls. The uncured material in the second layer 906 can then be removed by solvent to reveal the flow channels and chambers 910. In examples described herein, a single resistor window decreases the complexity of the topography in underlying surfaces, lowering the amount of extraneous reflections of the UV light off of coatings, such as the anticavitation layer. Accordingly, the walls formed from the second layer 906 are less distorted by cross-linking caused by extraneous reflections, which may improve the quality of the printhead.

A third layer 908, such as another layer of epoxy, is applied over the second layer 906 and masked to allow the creation of flow channel caps 912 and nozzles 914. As for the second layer 906, the simplification of the underlying topography, for example, by the use of a single resistor window, may decrease extraneous reflections and improve the quality of the printhead 800. However, the effects may be more attenuated for the third layer 908.

Figure 10:
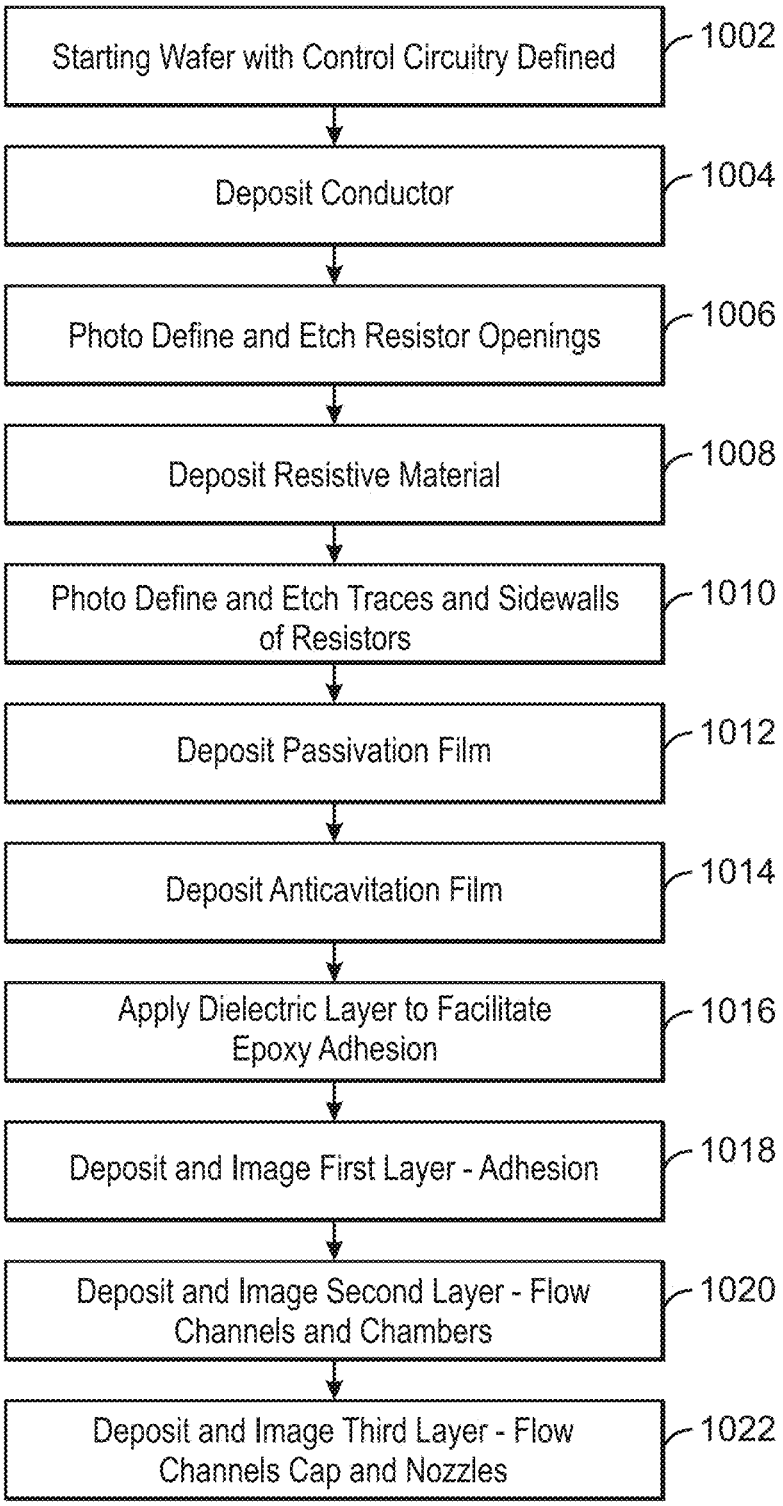
FIG. 10 is a process flow diagram of an example method to fabricate an ink jet printhead.

FIG. 10 is a process flow diagram of an example method 1000 to fabricate an ink jet printhead. The method 1000 begins at block 1002 with the fabrication of a starting wafer. The starting wafer will typically have control electronics already defined, and vias through the top dielectric layer to which a conductor layer can bond.

A number of initial actions can be used to create the traces and resistors used to heat the ink for ejecting a droplet at a surface. At block 1004, the conductor layer, such as aluminum, is deposited over the starting wafer. At block 1006, resistor openings are created, for example, by masking and etching the conductor layer. In various examples described herein, the resistor window is a single opening in the conductor layer that extends across the resistor area, decreasing the complexity of the topology of subsequent layers and improving the quality of layers used to form flow channels and chambers. In one example, the resistor window has a substantially uniform width, creating resistors, in subsequent steps, that have a substantially uniform length. At block 1008, a resistive material is deposited over the entire wafer, including the remaining conductor and the etched resistor window. At block 1010, traces and resistors are defined by masking and etching the conductor and resistor layers in the desired pattern. In some examples described herein, the traces and resistors that are formed alternate between wider and narrower regions, to provide different droplet sizes.

Further steps are used to protect the traces and resistors, and prepare the wafer for completion of the printhead. At block 1012, a passivation film is deposited over the traces and resistors, for example, to protect the traces and resistors from physical or chemical damage and to insulate them from subsequent layers. At block 1014, an anticavitation film is deposited over the passivation film, for example, to protect the resistors from cavitation. At block 1016, a dielectric film may be deposited over the passivation film to enhance the adhesion of subsequent layers, such as an epoxy primer layer. In some examples, the dielectric layer may be omitted.

Once the surface is prepared, subsequent layers may be formed to complete the printhead. At block 1018, a first layer is deposited to enhance adhesion of subsequent layers. At block 1020, a second layer is deposited, then masked and exposed to light to create flow channels and chambers, once any material that is not cross-linked is removed. At this point, the benefits of decreasing the topography of from the creation of the resistors can be obtained. Reflections from more complex topographical features, such as from a tantalum passivation, may cause crosslinking of unexpected regions, creating rough surfaces, or even possible partial obstructions, in the flow channels and chambers. The rough surfaces may impede the flow of ink into the nozzles. At block 1022, a third layer is deposited over the flow channels and chambers. This layer may be masked and exposed to light to create nozzles and flow caps. The completed wafer can then be divided into segments and mounted to form the printhead.

The ink jet printheads described herein may be used in other applications besides two dimensional printing. For example, in three dimensional printing or digital titration, among others. In these examples, the different sizes of drop generators may be of benefit for other reasons. In digital titration, the HDW drop generator may be used to approach an end point quickly, while the LDW drop generator may be used to accurately determine the end point.

The present examples may be susceptible to various modifications and alternative forms and have been shown only for illustrative purposes. Furthermore, it is to be understood that the present techniques are not intended to be limited to the particular examples disclosed herein. Indeed, the scope of the appended claims is deemed to include all alternatives, modifications, and equivalents that are apparent to persons skilled in the art to which the disclosed subject matter pertains.

What is claimed is:

1. A printhead, comprising:

a single resistor window formed in a conducting layer within the printhead;

a plurality of resistors formed in a resistor layer deposited over the single resistor window; and a plurality of nozzles from which droplets are ejected, wherein the plurality of nozzles include a distinct nozzle for each of the plurality of resistors.

2. The printhead of claim 1, wherein the plurality of resistors have two different widths, and wherein each of the two different widths is to eject a different droplet size when energized.

3. The printhead of claim 2, wherein resistors of the plurality of resistors having a first width of the two different widths are fired using different firing pulses than other resistors of the plurality of resistors having a second width of the two different widths.

4. The printhead of claim 1, wherein the plurality of nozzles are aligned over the plurality of resistors within a perimeter of the single resistor window.

5. The printhead of claim 1, wherein the single resistor window comprises a non-uniform length in a direction perpendicular to widths of the plurality of resistors, and the non-uniform length provides for shorter and longer resistors in the direction.

6. The printhead of claim 5, wherein the shorter and longer resistors are justified along an edge.

7. The printhead of claim 6, wherein the edge is located proximate an ink feed of the printhead.

8. The printhead of claim 6, wherein the edge is located opposite from ends of the plurality resistors that are proximate an ink feed of the printhead.

9. The printhead of claim 5, wherein the single resistor window has curved edges between shorter and longer resistors.

10. The printhead of claim 5, wherein the single resistor window has chamfered edges between shorter and longer resistors.

11. A method for forming a printhead, comprising:

forming a single resistor window in a conducting layer within the printhead;

forming a plurality of resistors in a resistor layer deposited over the single resistor window; and forming a plurality of nozzles from which droplets are ejected, wherein the plurality of nozzles include a distinct nozzle for each of the plurality of resistors.

12. The method of claim 11, comprising depositing a passivation film over the plurality of resistors; and depositing an anticavitation film over the passivation film.

13. The method of claim 11, comprising etching the single resistor window at a substantially uniform width to form resistors of substantially the same length.

14. The method of claim 11, comprising etching the single resistor window at different widths to form the plurality of resistors as resistors of different lengths.

15. The method of claim 14, comprising justifying the plurality of resistors along one edge.

16. The method of claim 15, comprising justifying the plurality of resistors along an ink feed chamber.

17. The method of claim 14, comprising chamfering the single resistor window between the plurality of resistors.

18. The method of claim 14, comprising alternating two different widths for the single resistor window to form resistors of alternating length.

19. A printer comprising a printbar, wherein the printbar comprises a printhead that comprises:

a plurality of nozzles aligned over a single resistor window formed in a conductive layer of the printhead;

a plurality of resistors within the single resistor window, wherein each of the plurality of resistors is aligned with a distinct nozzle of the plurality of nozzles; and a controller to apply a firing pulse to each of the plurality of resistors.

20. The printer of claim 19, wherein the controller is to apply a substantially equivalent firing pulse to each of the plurality of resistors.

* * * * *